US009999335B2

(12) United States Patent
Clark et al.

(10) Patent No.: US 9,999,335 B2
(45) Date of Patent: Jun. 19, 2018

(54) SURFACE MAINTENANCE MACHINE WITH A HEAD ADJUSTMENT MECHANISM

(71) Applicant: Tennant Company, Minneapolis, MN (US)

(72) Inventors: Justin Michael Clark, Hudsonville, MI (US); Nicholas Edwin Boers, West Olive, MI (US); Leo Jason Baker, Holland, MI (US)

(73) Assignee: Tennant Company, Minneapolis, MN (US)

( * ) Notice: Subject to any disclaimer, the term of this patent is extended or adjusted under 35 U.S.C. 154(b) by 240 days.

(21) Appl. No.: 14/597,028

(22) Filed: Jan. 14, 2015

(65) Prior Publication Data

US 2015/0196183 A1 Jul. 16, 2015

Related U.S. Application Data

(60) Provisional application No. 61/927,772, filed on Jan. 15, 2014.

(51) Int. Cl.
*A47L 11/40* (2006.01)
*A47L 11/16* (2006.01)
(Continued)

(52) U.S. Cl.
CPC ..... *A47L 11/4052* (2013.01); *A47L 11/14* (2013.01); *A47L 11/16* (2013.01); *A47L 11/4038* (2013.01);
(Continued)

(58) Field of Classification Search
None
See application file for complete search history.

(56) References Cited

U.S. PATENT DOCUMENTS 3,436,788 A * 4/1969 Tamny ..... E01H 1/0845 15/340.3
4,122,576 A 10/1978 Bevington et al.
(Continued)

FOREIGN PATENT DOCUMENTS

EP 0751736 B1 1/1999
EP 1612678 A1 2/2006
(Continued)

OTHER PUBLICATIONS

Transmittal of International Search Report and Written Opinion for PCT/US2015/011402, dated Apr. 13, 2015, 12 pages.

*Primary Examiner* — Christopher M Koehler
*Assistant Examiner* — Brian Keller
(74) *Attorney, Agent, or Firm* — Fredrikson & Byron, P.A.

(57) ABSTRACT

Embodiments include a mechanism for leveling or providing pad assistance to surface maintenance machines. The surface maintenance machine can include a frame, a plurality of wheels, a head assembly, and a head adjustment mechanism. The head adjustment mechanism can be positioned in line with and operatively coupled to a first portion of the head assembly, such that the first portion of the head assembly can be moved towards or away from the surface by adjusting the position of a fastener in a slot. Such embodiments are useful for leveling the head assembly to maintain an even degree of burnishing or providing pad assistance. Embodiments include methods of using such mechanisms for leveling or providing pad assist to surface maintenance machines.

20 Claims, 16 Drawing Sheets

(51) Int. Cl.

| | |
|---|---|
| ***B24B 7/18*** | (2006.01) |
| ***B24B 23/02*** | (2006.01) |
| ***B24B 23/00*** | (2006.01) |
| ***A47L 11/14*** | (2006.01) |

(52) U.S. Cl.
CPC ..... *A47L 11/4058* (2013.01); *B24B 7/186* (2013.01); *B24B 23/005* (2013.01); *B24B 23/02* (2013.01)

(56) References Cited

U.S. PATENT DOCUMENTS

| | | | | | |
|---|---|---|---|---|---|
| 4,358,868 | A * | 11/1982 | Cook, Jr. ..... | A47L 11/162 | 15/49.1 |
| 4,571,771 | A | 2/1986 | Worwa | | |
| 4,805,258 | A * | 2/1989 | Sitarski ..... | A47L 11/164 | 15/230.17 |
| 5,901,407 | A | 5/1999 | Boomgaarden | | |
| 6,131,240 | A | 10/2000 | Shark et al. | | |
| 7,137,876 | B2 | 11/2006 | Immordino et al. | | |
| 8,276,859 | B1 | 10/2012 | Caddell | | |
| 8,282,445 | B2 | 10/2012 | Goldberg et al. | | |
| 2011/0316251 | A1* | 12/2011 | Lumpkin ..... | B62K 19/30 | 280/285 |

FOREIGN PATENT DOCUMENTS

| | | | |
|---|---|---|---|
| EP | 1621678 | A1 | 2/2006 |
| FR | 2154542 | A1 | 5/1973 |
| FR | 2765793 | A1 | 1/1999 |
| GB | 2327037 | A | 1/1999 |
| IE | 37513 | B1 | 8/1977 |

* cited by examiner

SURFACE MAINTENANCE MACHINE WITH A HEAD ADJUSTMENT MECHANISM

FIELD

This disclosure generally relates to systems and methods for leveling floor maintenance machines.

BACKGROUND

Surface maintenance machines that perform surface maintenance or surface conditioning tasks are well known. Such machines are generally useful for treating or maintaining a surface. The term surface, as used herein, generally refers to any support surface, (e.g., floors, pavements, road surfaces, ship decks, and the like). Surface maintenance machines can perform tasks such as sweeping, scrubbing, and polishing (e.g., burnishing). Machines may additionally include vacuum elements to remove dirt, debris, and liquids (e.g., floor cleaning solution, water and the like). Some surface maintenance machines may perform multiple types of surface maintenance tasks.

Surface maintenance machines commonly include a driver assembly which includes a working appliance or tool (e.g., a pad or brush), coupled to a driver that is rotatably driven by a motor assembly. The driver assembly may be selectively raised and lowered by an actuator to transition between a raised position (during transport or storage) and a lowered position (while performing a surface maintenance task). Prior to performing a surface maintenance task, the assembly may be lowered into the lowered position.

Surface maintenance machines performing a burnishing task generally include a mechanism for controlling the degree of burnishing (e.g., to meet a sufficient level of floor finish). When burnishing floors, the burnishing pad is typically leveled against the floor surface, such that every part of the pad maintains an equal distance from the floor surface. It is often the case that brushes and pads wear unevenly over time if the head assembly is not leveled (e.g., due to manufacturing tolerances in various fasteners and components of the head assembly), or an uneven pad surface. In such cases a technician may attempt to level the head assembly to compensate for such variations.

SUMMARY

In one embodiment, a surface maintenance machine includes a head adjustment mechanism coupled to a head assembly. The head adjustment mechanism can adjust the position of the head assembly such that a first portion and a second portion of the head assembly are equidistant from a surface. The head adjustment mechanism includes a first fastener, a second fastener, and a third fastener slidably coupled to at least a portion of the head bracket. The sliding movement of the third fastener results in moving the first portion of the head assembly towards or away from the surface. The third fastener can be positioned against the head bracket at a first position. The second fastener abuts against the third fastener at a second position to prevent the third fastener from further sliding against the portion of the head bracket. The first fastener can lock the position of the third fastener to the head bracket. When leveled as described above, the pad applies even pressure on the surface at the first portion and second portion.

In a second embodiment, the head adjustment mechanism can be adjusted such that the surface maintenance machine can move across a surface during operation, because of the head assembly (and consequently the spinning pad) being angled in a plane with respect to the surface. The position of the third fastener can be locked on to a portion of the head bracket, thereby fixing the position of a first portion of the head assembly with respect to the surface, such that a line connecting a first point on the pad at the first portion and a second point on the pad at a second portion of the head assembly forms an angle in a range approximately 0.5 degrees to approximately 10 degrees with respect to a first reference axis. In some embodiments, the line connecting the first point and the second point form an angle of approximately 2 degrees. Such an embodiment can generate a force sufficient to propel the machine across the surface.

BRIEF DESCRIPTION OF THE DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
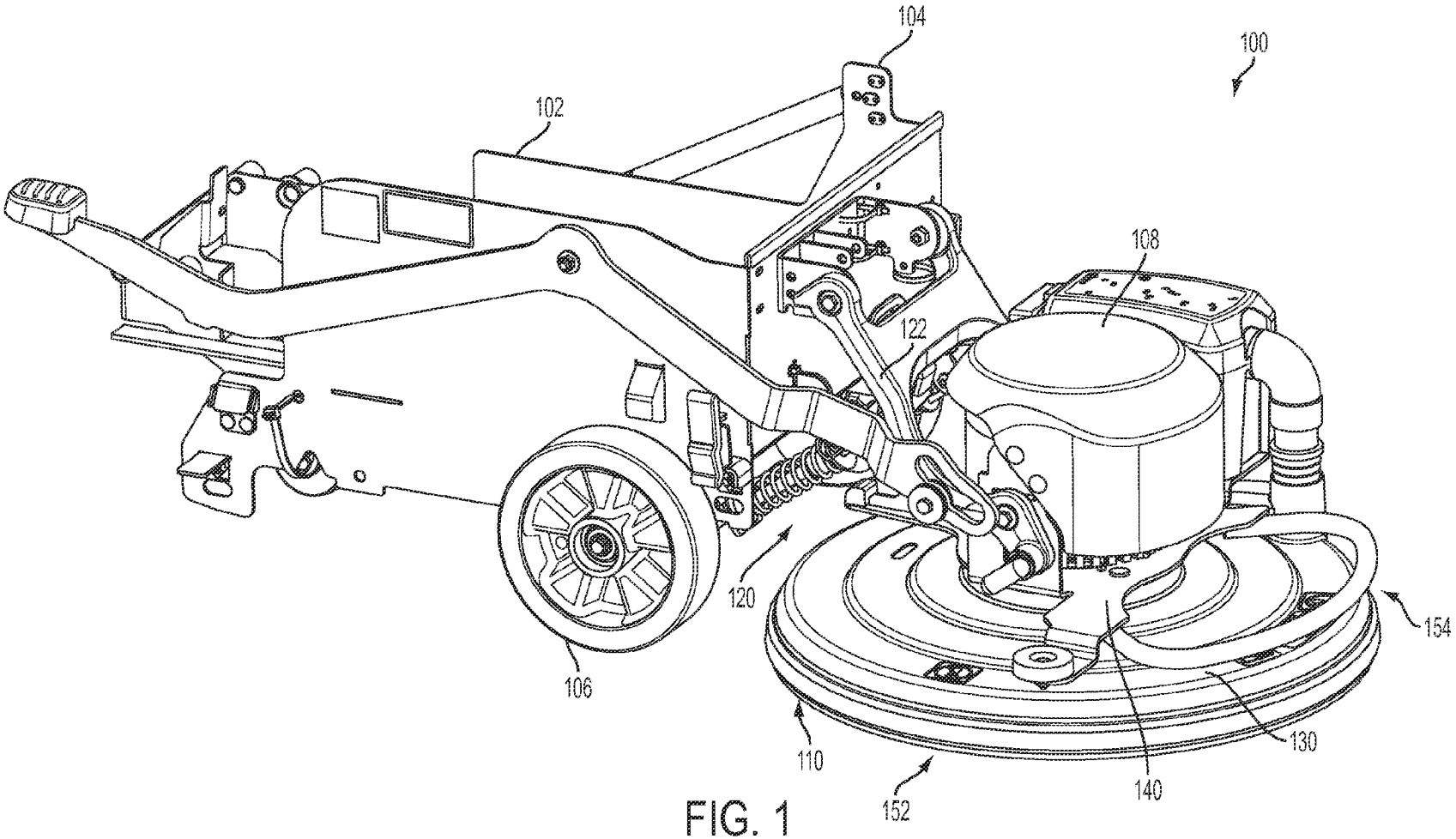
FIG. 1 is a perspective view of a surface maintenance machine according an embodiment of the invention.

FIG. 1 is a perspective view of an exemplary surface maintenance machine 100. In the illustrated embodiment, the surface maintenance machine 100 is a walk-behind machine used to treat hard floor surfaces. In other embodiments, the surface maintenance machine can instead be a ride-on or towed-behind machine, such as the machines described in U.S. Pat. No. 5,901,407 and U.S. Pat. No. 4,571,771 assigned to Tennant Company of Minneapolis, Minn., the disclosure of each of which is hereby incorporated by reference in its entirety. The surface maintenance machine can perform maintenance tasks such as sweeping, scrubbing, polishing (burnishing) a surface. The surface can be a floor surface, pavement, road surface and the like.

Figure 2:
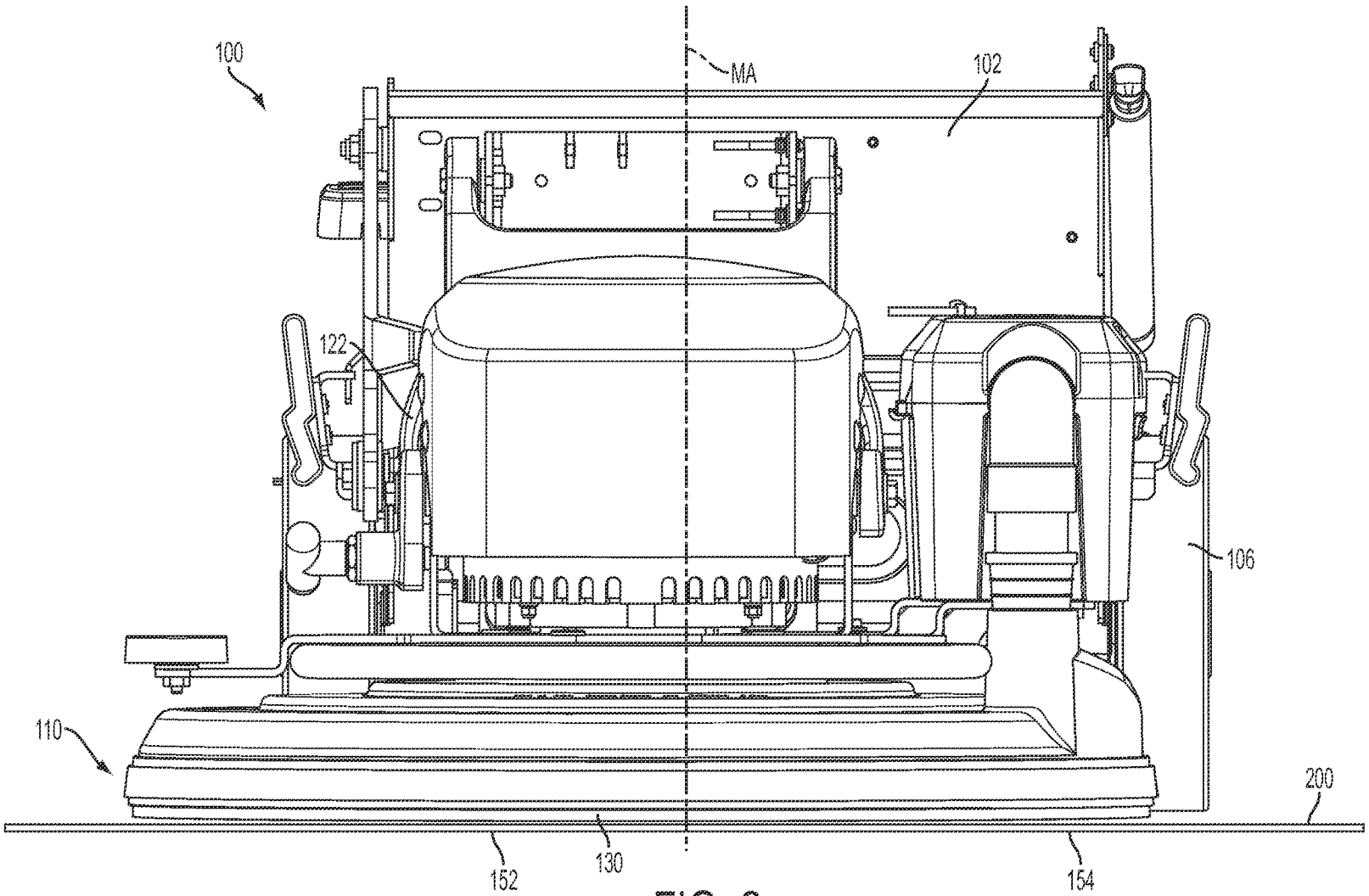
FIG. 2 is a front view of the surface maintenance machine of FIG. 1.

Embodiments of the surface maintenance machine 100 include components that are supported on a mobile body 102. As best seen in FIGS. 1 and 2, the mobile body 102 comprises a frame 104 supported on wheels 106 for travel over a surface 200, on which a surface maintenance operation is to be performed. The mobile body 102 may include operator controls (not shown) and a steering control (not shown) such as a steering wheel. The surface maintenance machine 100 can be powered by an on-board power source 108 such as one or more batteries or an internal combustion engine. Although the power source 108 is shown proximate the front of the machine, it may instead be located elsewhere, such as within the interior of the machine, supported within the frame 104, and/or proximate the rear of the machine. Alternately, the machine 100 can be powered by an external electrical source via an electrical outlet.

In some embodiments, the interior of the machine can include a vacuum system for removal of debris from the surface 200. In some embodiments, the interior can include a fluid source tank (not shown) and a fluid recovery tank (not shown). The fluid source tank can include a fluid source such as a cleaner or sanitizing fluid that can be applied to the floor surface during treating operations. The fluid recovery tank holds recovered fluid source that has been applied to the floor surface and soiled. The interior of the machine can include passageways (not shown) for passage of debris and dirty water. The interior of the machine can include electrical connections (not shown) for transmission and control of various components.

Figure 3:
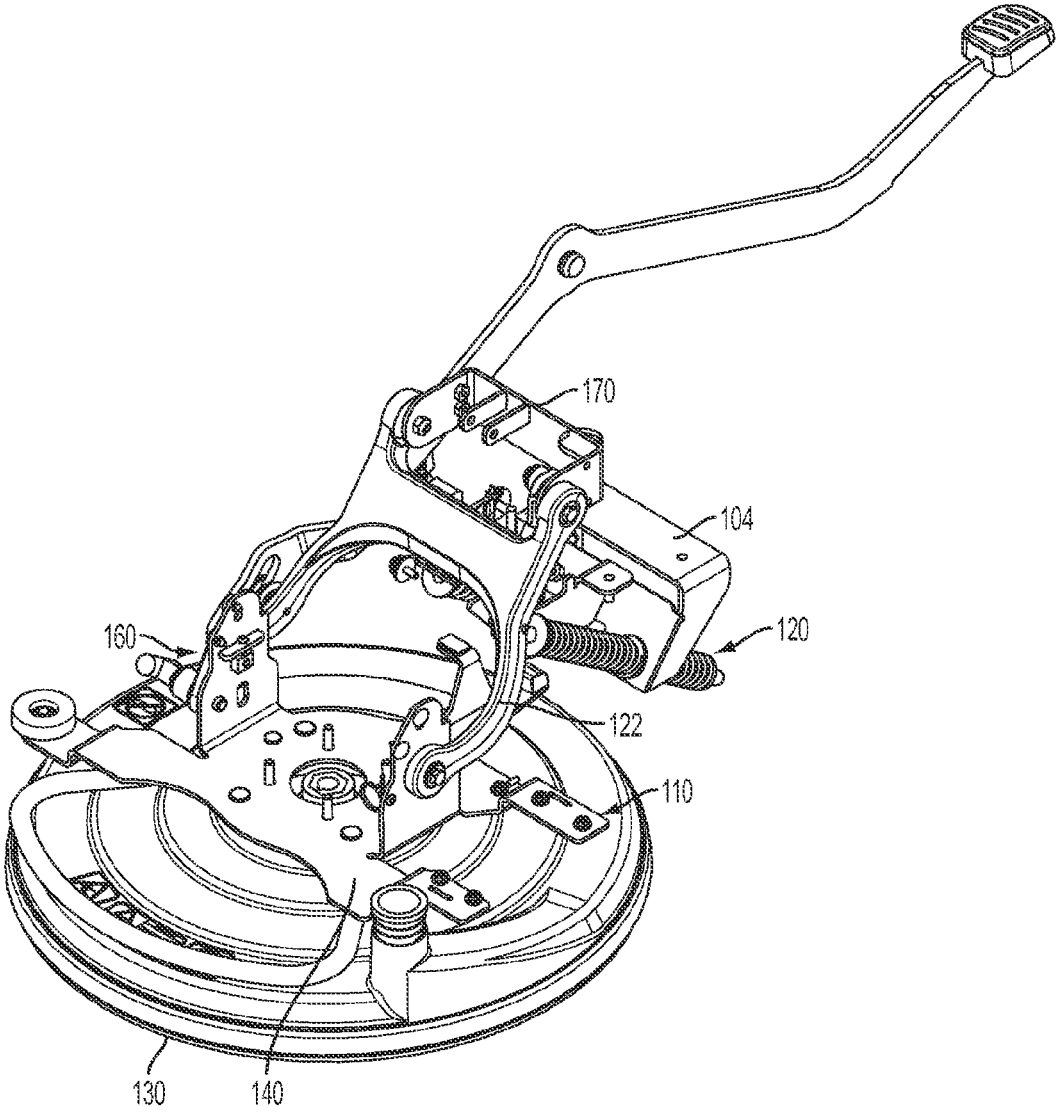
FIG. 3 is a perspective view of a head assembly of a surface maintenance machine according to an embodiment of the invention.
Figure 4:
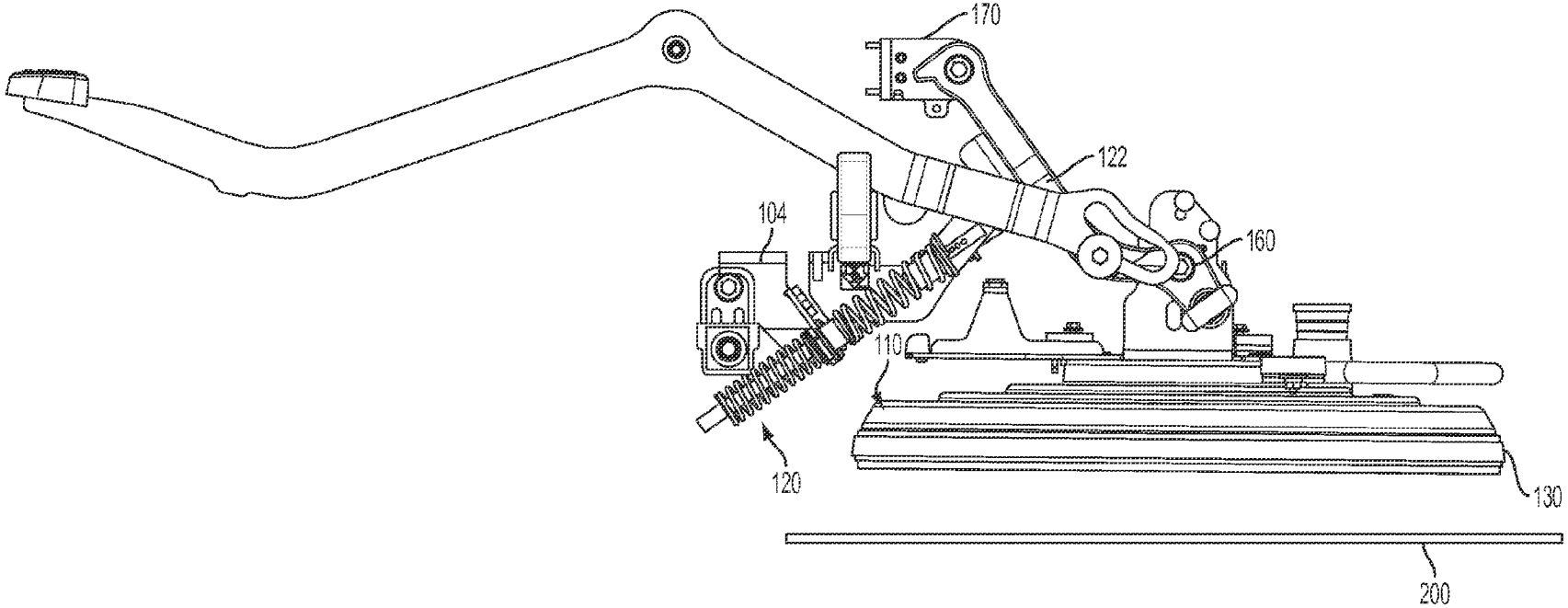
FIG. 4 is a side view of the head assembly of FIG. 3.
Figure 5:
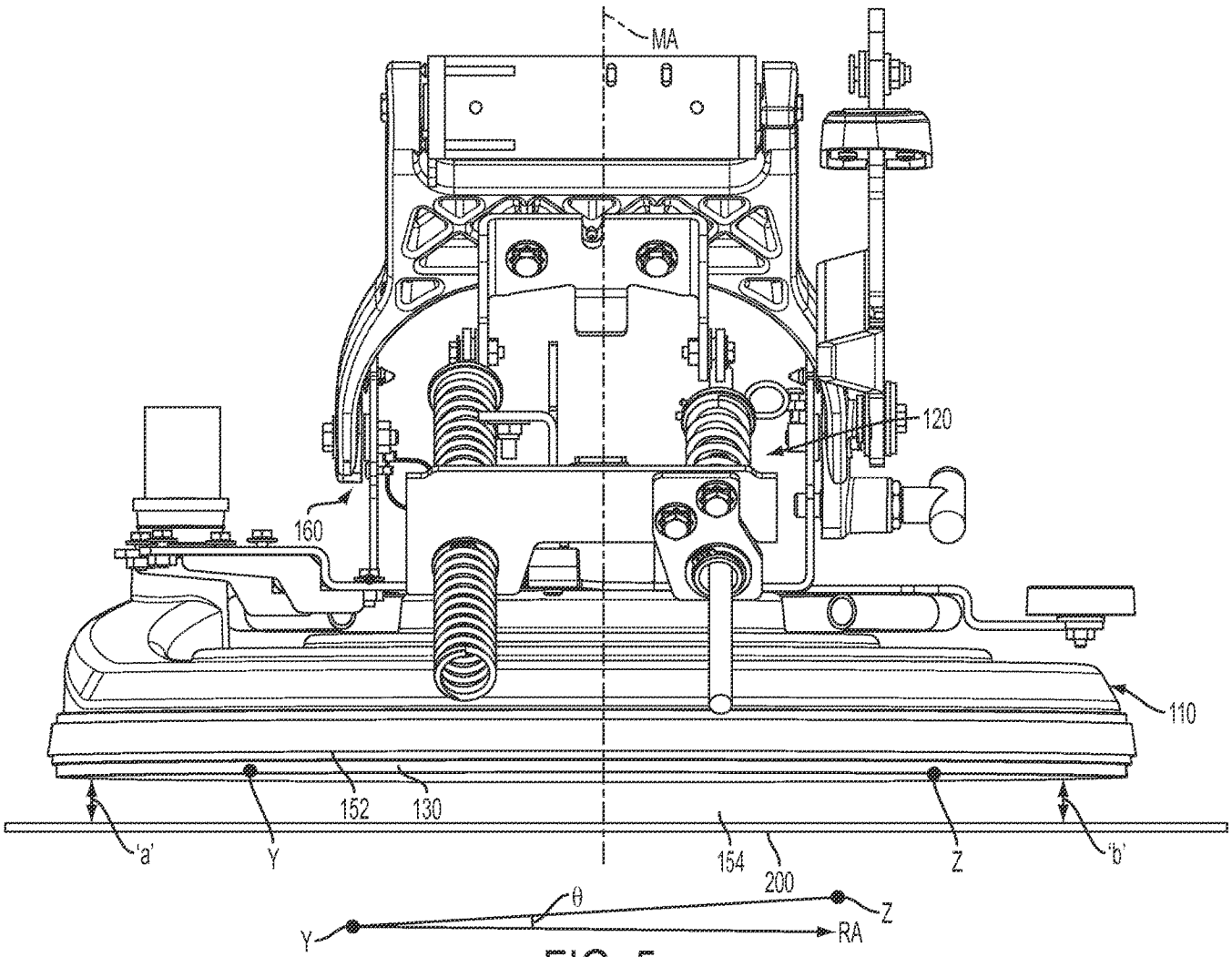
FIG. 5 is a front view of the head assembly of FIG. 3.

Referring now to FIGS. 3-5, surface maintenance machine 100 may comprise a head assembly 110. The head assembly 110 can be coupled to the frame 104 such that the head assembly 110 can be lowered during operation to treat a surface 200 and raised for transport or storage. In some embodiments, the head assembly 110 can be raised or lowered by a suspension mechanism 120. Any of the suspension mechanisms (e.g., spring and lever coupled to a linear actuator) known in the art can be used without limiting the scope of the invention. The suspension mechanism 120 may apply a downforce during the lowering of the head assembly 110 and a lift force during the lifting of the head assembly 110. In certain embodiments, the suspension mechanism 120 may apply a reduced lift force, instead of a downforce, during the lowering of the head assembly 110. The technician may actuate the linear actuator and/or spring and lever mechanism to raise or lower the head assembly 110 and/or apply a downforce or a lift force.

The head assembly 110 may include a motor positioned on a housing. The motor can be operably coupled to the on-board power source to drive a driver. The motor may be powered by an electrical source via an electrical outlet or a battery, and can supply power to various components of the machine for transport and surface maintenance operations. In some embodiments, the driver may provide power to a pad for performing a surface maintenance task. The pad may be coupled to a head bracket. In some embodiments, the pad can be a burnishing pad for burnishing a floor surface. In other embodiments, the pad can be a scrubbing pad (e.g., scrub brush) for sweeping and/or scrubbing a floor surface. In some embodiments, the pad spins about a machine axis.

Manufacturing tolerances in any of the components of the head assembly may cumulatively result in the head assembly not being level or at the desired angular orientation relative to the surface on which the machine operates. In order to level or adjust the orientation, certain embodiments of the surface maintenance machine may include a head adjustment mechanism coupled to the head assembly, via which, one may compensate for the cumulative tolerances and manufacturing defects in various components of the head assembly so as to set a desired operating orientation of the head assembly. In general, the head adjustment mechanism can adjust the angular orientation of a first portion of the of the surface maintenance machine relative to a second portion of the machine. In some embodiments, the first portion can refer to the portion of the head assembly at the left side of the machine (sometimes referred to as "machine left side") and the second portion can refer to the portion of the head assembly at the right side. The first and second portions can be bottom portions of the head assembly. In some embodiments, the first and second portions may refer to bottom portions of the pad coupled to a head bracket of the head assembly. Thus, the head adjustment mechanism can adjust the angular orientation of the head assembly (or merely the angular orientation of the pad) with respect to the surface. This may allow for leveling of the head assembly, wherein the first and second portions are equidistant from the surface and the head assembly is parallel to the surface, or allow for an angular positioning of the head assembly with respect to the surface. In some embodiments, an angular orientation of the head assembly may provide pad assistance, as will be described elsewhere herein.

Figure 6:
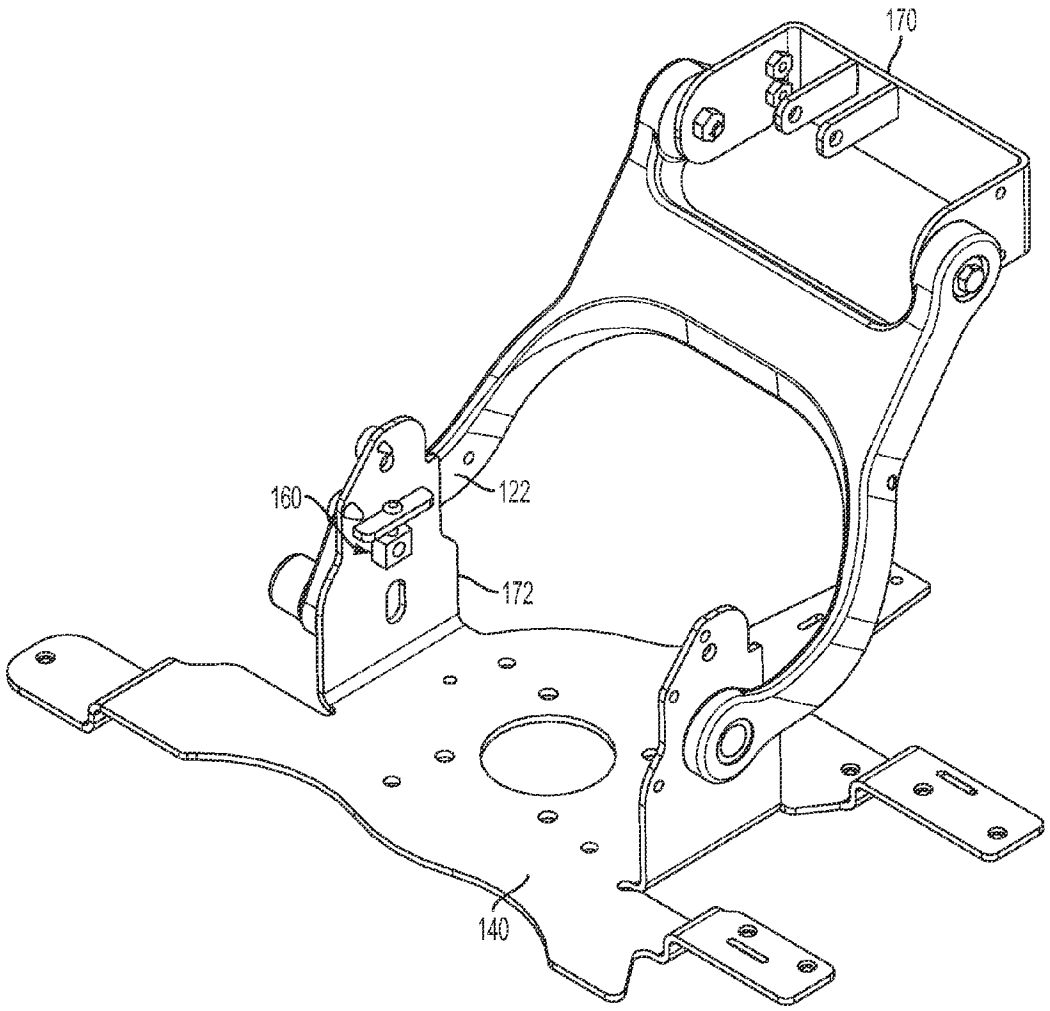
FIG. 6 is a perspective view of a head adjustment mechanism for a surface maintenance machine according to an embodiment of the invention.
Figure 7:
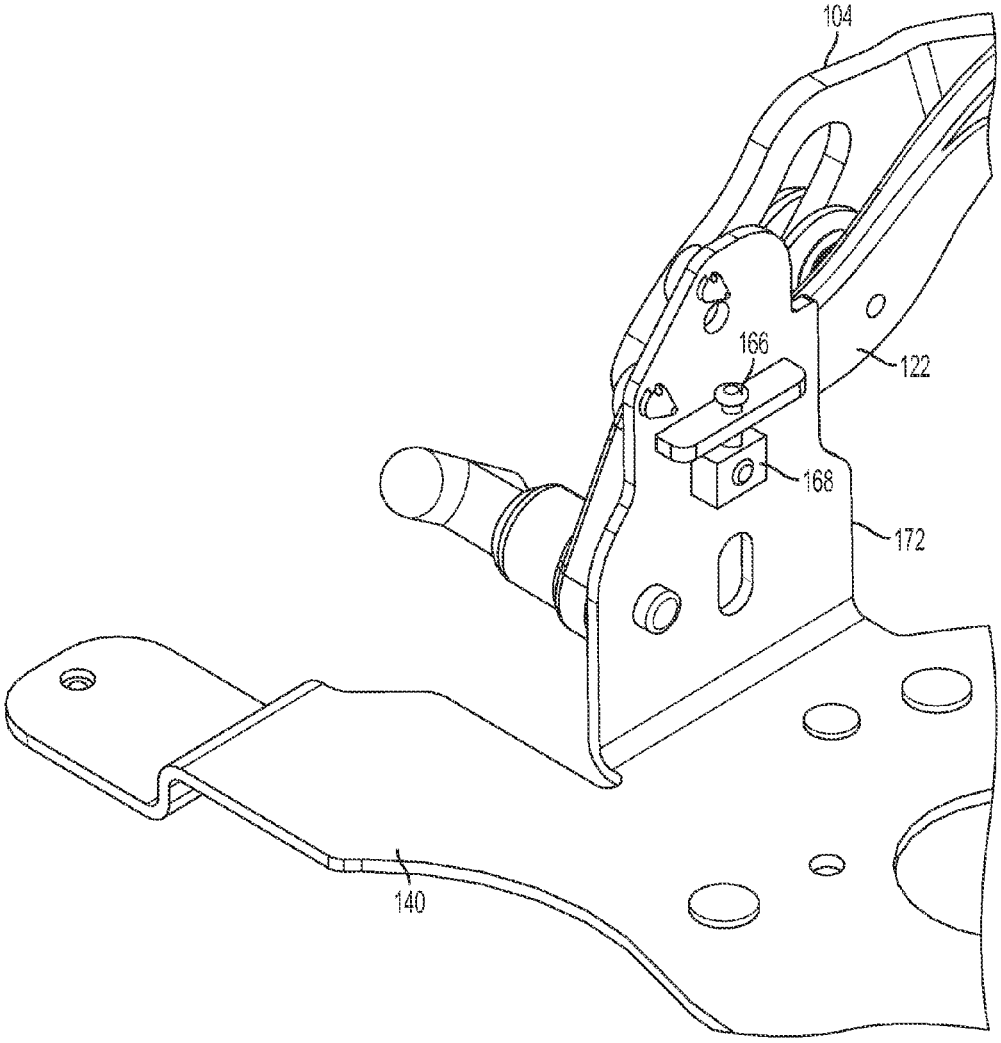
FIG. 7 is a perspective view of a portion of the head adjustment mechanism of FIG. 6.

Referring now to FIGS. 5-7, the head adjustment mechanism 160 can be operatively coupled at any location on the frame 104 of the surface maintenance machine 100. In some embodiments, the head adjustment mechanism 160 can be positioned in line with and operatively coupled to the first portion 152 of the head assembly 110 such that the head adjustment mechanism 160 can adjust the angular orientation of the first portion 152 with respect to the second portion 154. In an exemplary embodiment illustrated in FIGS. 5-7, the head adjustment mechanism 160 is coupled to the left side ("machine left side") of the machine 100 so that the first portion 152 of the head assembly 110 can be angled relative to the second portion 154. As best seen in FIG. 5, the head adjustment mechanism 160 may level the head assembly 110 such that the pad 130 applies pressure evenly on the surface 200 to the right and left side of the of the head assembly 110, which may also be deemed as the right and left side, respectively, of the machine axis 'MA'. In such embodiments, the distance 'a', seen as the height between the surface 200 and the left side of the head assembly 110, equals distance 'b', seen as the height between the surface 200 and the right side of the head assembly 110.

In other embodiments, the head adjustment mechanism 160 can be useful for adjusting the angular orientation of the head assembly 110 for pad assistance. In such embodiments, a line connecting a point 'Y' on the pad 130 at the first portion 152 and a point 'Z' on the pad 130 at the second portion 154 of the head assembly 110 (best seen in FIG. 5) forms an angle 'A' with respect to a reference axis 'RA'. The reference axis 'RA' can refer to a line disposed along the surface 200. In the illustrated embodiment shown in FIG. 5, the reference axis 'RA' is a horizontal axis. In embodiments where the head assembly 110 is level with the surface 200, the angle θ can be zero. In embodiments wherein pad assistance is provided, the angle θ can be non-zero.

Figure 8:
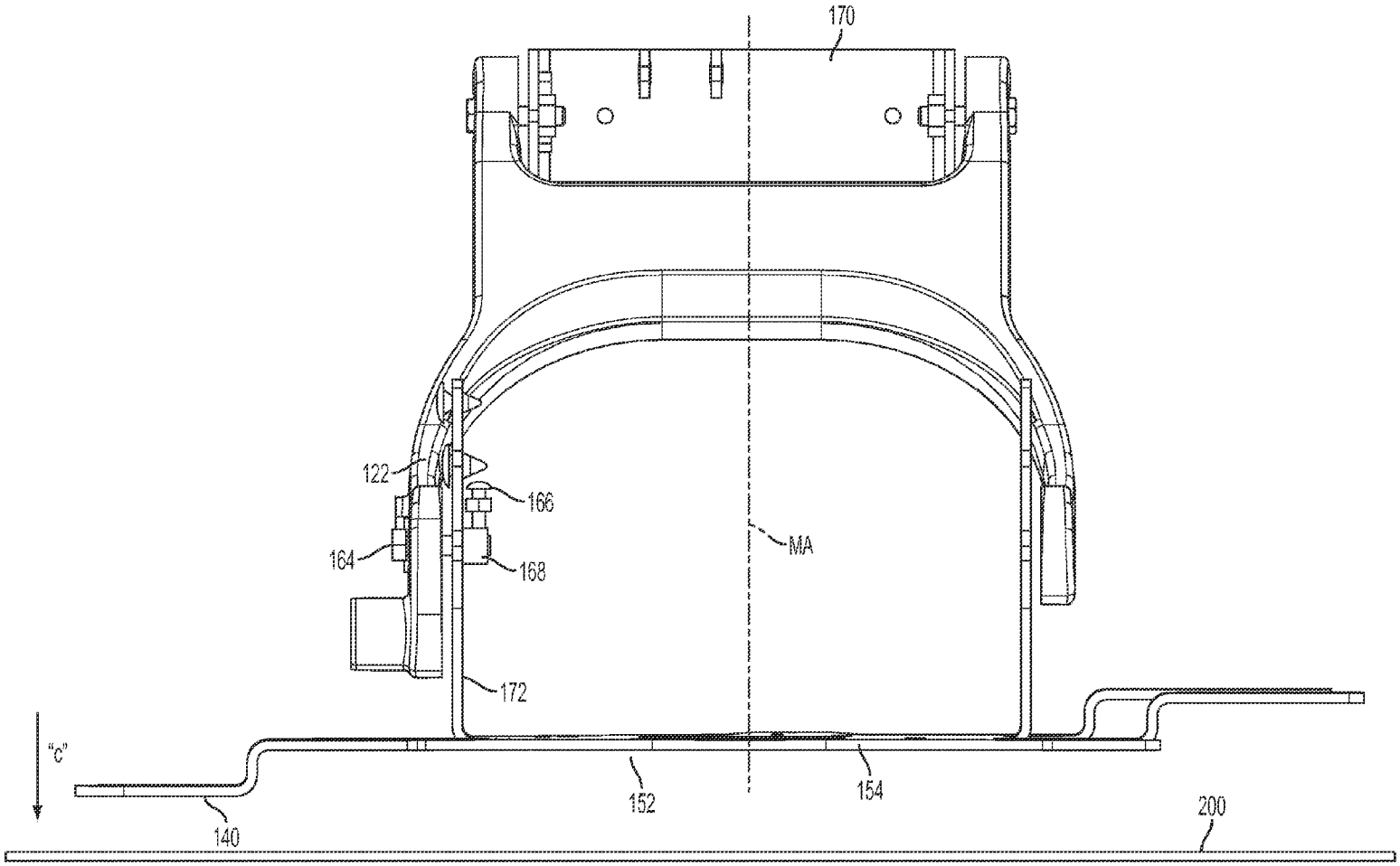
FIG. 8 is a front view of the head adjustment mechanism of FIG. 6.
Figure 9:
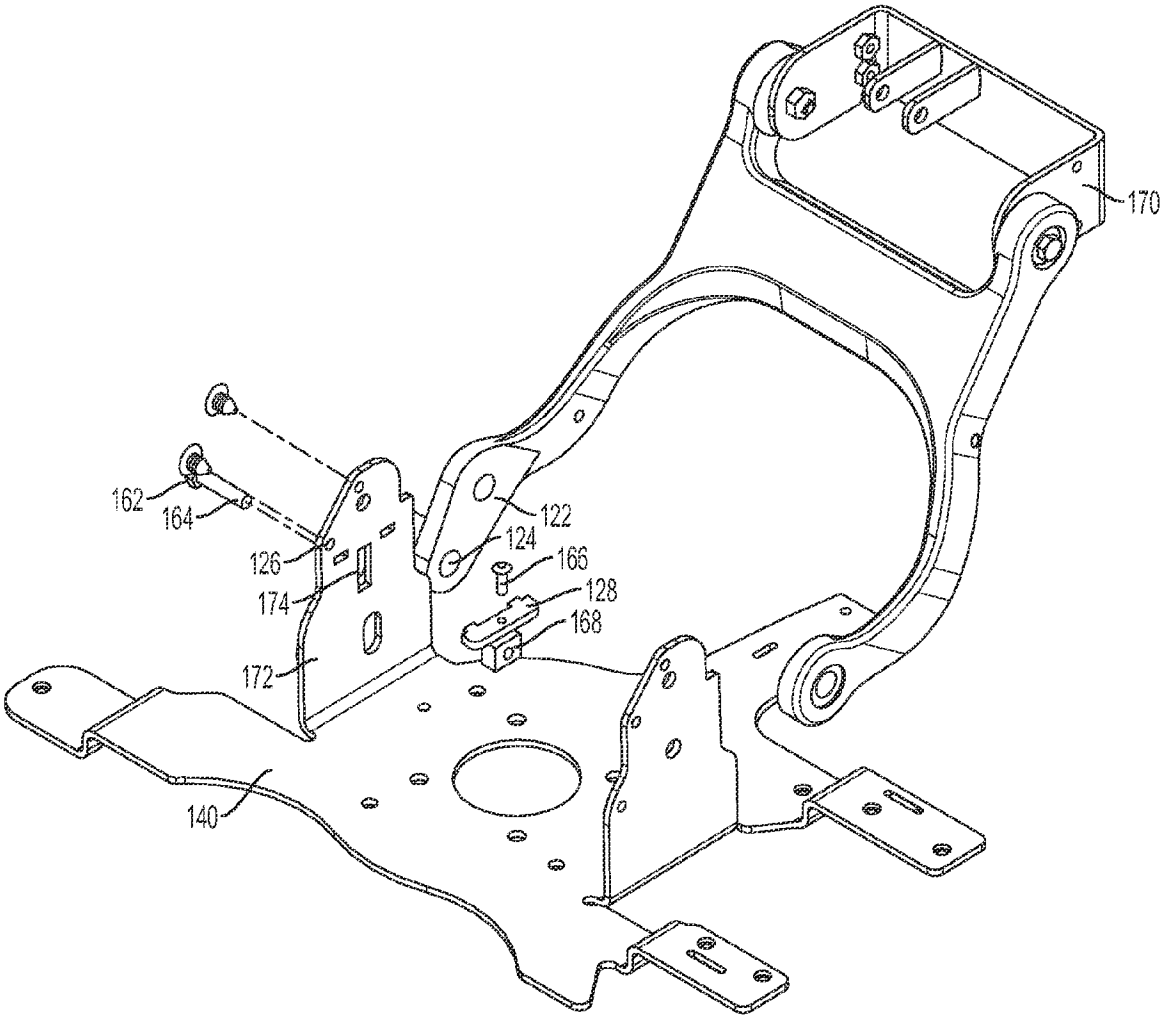
FIG. 9 is an exploded perspective view of the head adjustment mechanism of FIG. 6.

Referring now to FIGS. 7 and 8, the head adjustment mechanism 160 can include a flange 172 operatively coupled to the head bracket 140 and positioned on the first portion 152. In the illustrated embodiment best seen in FIGS. 7 and 8, the flange 172 is welded to the head bracket 140. The driver (not shown) and the pad 130 (best seen in FIG. 5) are positioned on the head assembly 110. Thus, raising or lowering the first portion 152 of the head assembly 110 away from or toward the surface 200 can adjust the angular orientation of the pad 130 with respect to the surface 200. As shown in the exploded perspective view of FIG. 9, the head adjustment mechanism 160 can include a first fastener 162, a second fastener 166, and a third fastener 168. In such embodiments, the head assembly 110 can most easily be leveled by adjusting the position of the third fastener 168 in a slot 174 on the flange 172.

Figure 10:
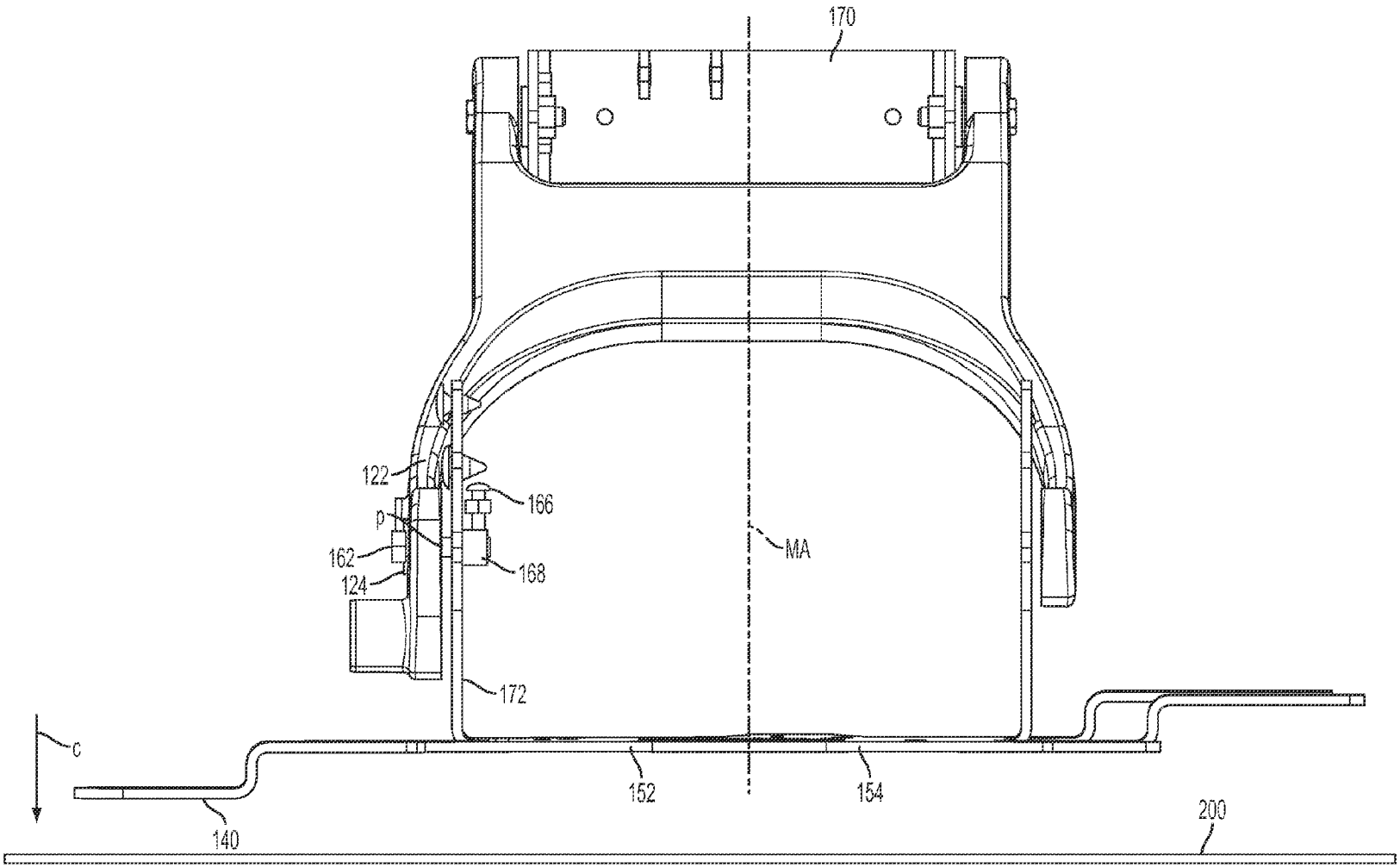
FIG. 10 is a front view of the head adjustment mechanism of FIG. 6.
Figure 11:
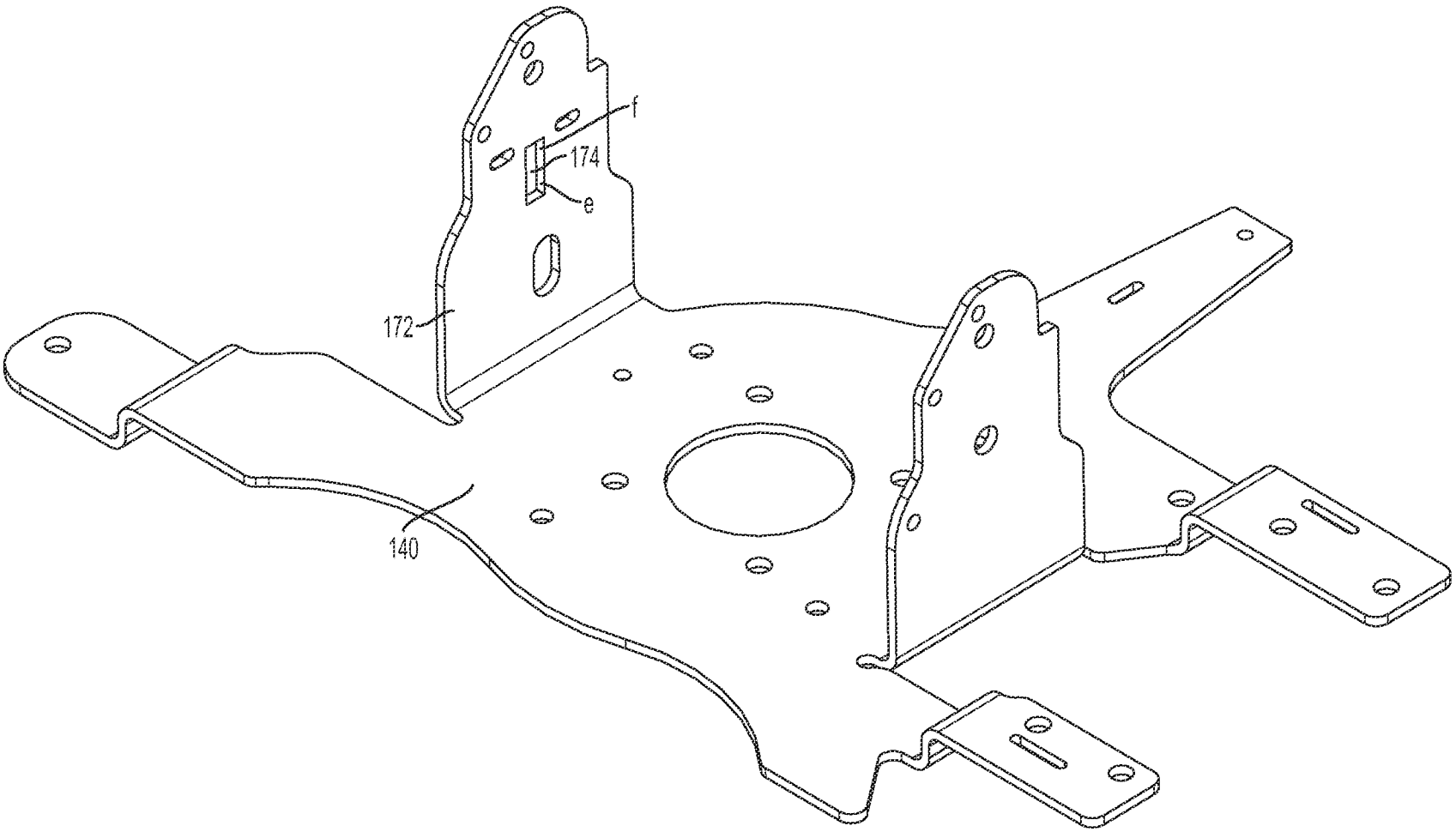
FIG. 11 is a perspective view of a head bracket.
Figure 12:
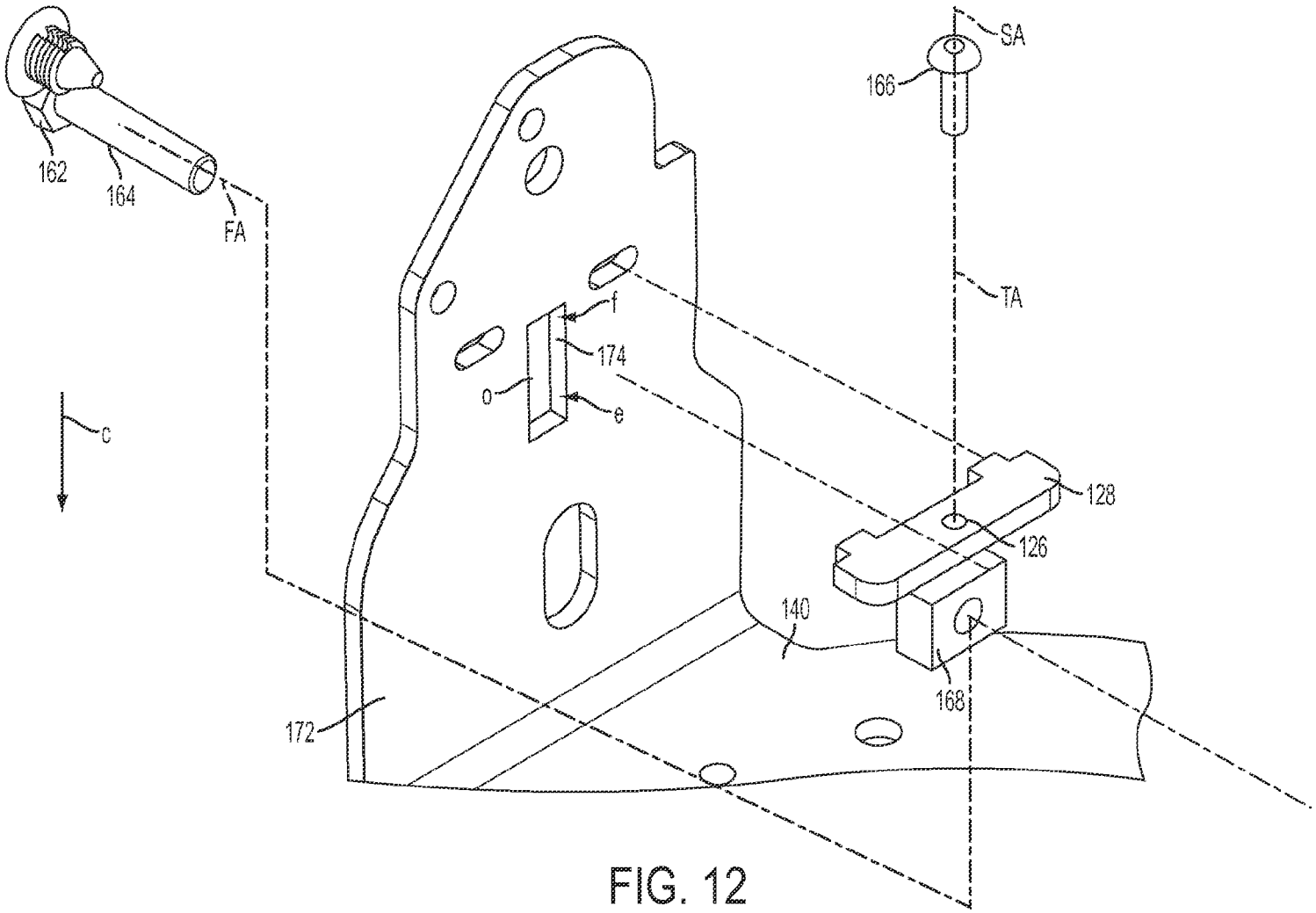
FIG. 12 is an exploded perspective view of a portion of the head adjustment mechanism of FIG. 5.

As seen in FIGS. 10 and 11, the first fastener 162 can extend through the flange 172, for instance, through an elongated slot 174 in the flange. The first fastener 162 can also pass through a first opening 124 in the arm 122 of the suspension mechanism 120, thereby pivotably coupling the flange 172 (and the head bracket 140 welded thereto) to the arm at a pivot point 'P'. As shown in FIG. 12, the first fastener 162 can include an elongated shank portion 164 disposed about a first axis 'FA'. In some embodiments, the first fastener 162 can be a bolt (e.g., hex-headed or square-headed bolt) threadably engaging with the third fastener 168. The first fastener 162 can lock the position of the third fastener 168 to the head bracket 140. When the first fastener 162 is unfastened, for instance, by using a hex-headed wrench to loosen the bolt, the third fastener 168 is released and can slide freely about the slot 174 in the flange 172. As mentioned elsewhere herein, the head assembly 110 can be raised during transport or storage. When the head assembly 110 is in a raised position, unfastening the first fastener 162 causes the flange 172 and the head bracket 140 welded thereto to move in a generally downward direction 'c' due to the weight of the head assembly 110.

With continued reference to FIG. 12, the second fastener 166 can extend through a second opening 126 in a tab 128. The tab 128 may be fixedly coupled to the flange 172 (e.g., by protrusions that engage with openings in the flange 172 as shown in FIG. 12). The second fastener 166 can be disposed about a second axis 'SA'. In the illustrated embodiment shown in FIG. 12, the second axis 'SA' is a generally vertical axis. In some embodiments, the second fastener 166 can be a screw. In such embodiments, the second opening 126 of the tab 128 can include internal threads. In the illustrated embodiment, the second fastener 166 is a jack screw. Any fastener that can be axially advanced along the second axis 'SA' by rotating the fastener can be used without loss of functionality. The second fastener 166 can be advanced through the second opening 126 until it abuts a portion of the third fastener 168. As the tab 128 is fixedly coupled to the head assembly 110, the position of the third fastener 168 can be fixed in the slot 174 to level the head assembly 110 on the left side of the machine axis 'MA'.

The third fastener 168 can be positioned against the head bracket 140 at a first position 'e'. The third fastener 168 can be slidably coupled to at least a portion of the head bracket 140. In some embodiments, the third fastener 168 can be received by (e.g., captured in) the slot 174 in the flange 172. In some embodiments, the third fastener 168 can be a locking nut (e.g., hex-shaped or square shaped nut) threadably engaging with the first fastener 162. In such embodiments, the third fastener 168 can include internal threads that can threadingly engage with external threads of the first fastener 162 (e.g., a bolt). The third fastener 168 can be received by the first fastener 162 at the first position 'e'.

Figure 13:
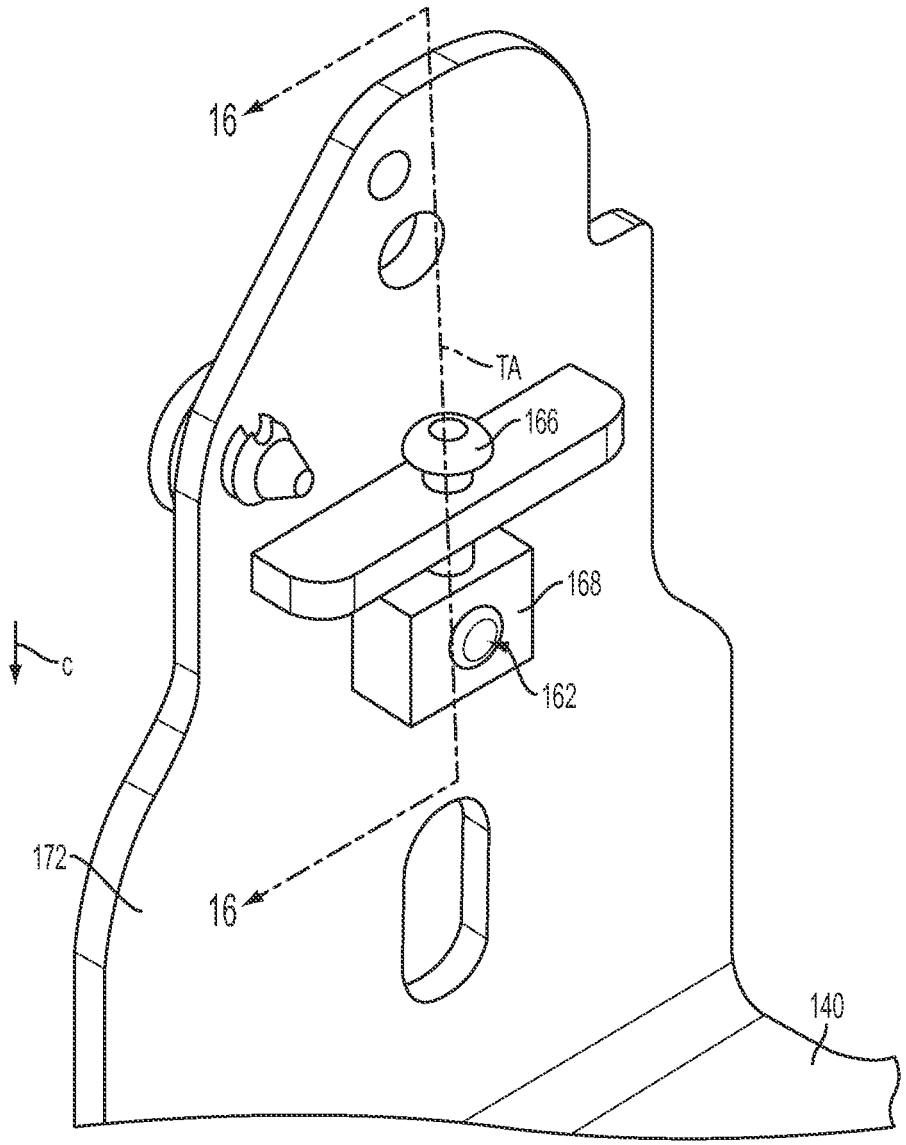
FIG. 13 is a perspective view of a portion of the head adjustment mechanism of FIG. 5.

In some embodiments, the third fastener 168 can be slidable with respect to the flange 172 along a third axis 'TA'. The third axis 'TA' can be perpendicular to the first axis 'FA' and parallel to the second axis 'SA'. In the illustrated embodiment shown in FIGS. 12 and 13, the third axis 'TA' is a vertical axis. In the embodiment shown in FIGS. 12 and 13, the second axis and the third axis are illustrated as collinear. Other configurations of the second and third axis may also be considered without loss of functionality. The sliding movement of the third fastener 168 results in moving the first portion 152 of the head assembly 110 towards or away from the surface 200. The second fastener 166 abuts against or couples to (e.g., via threads in the second opening 126) the third fastener 168 at the second position 'f' to prevent the third fastener 168 from further sliding against the portion of the head bracket 140. In some embodiments, releasing or loosening the first fastener 162 (e.g., by loosening the head of the first fastener 162 with a wrench) causes the third fastener 168 to slidably move in the slot 174 on the flange 172 from the first position 'e' to the second position T. In such embodiments, the second fastener 166 can abut against the third fastener 168 at the second position T, preventing the third fastener 168 from sliding any further, thereby fixing its position in the slot 174.

When the position of the third fastener 168 in the slot 174 is fixed in position, the position of the flange 172, and consequently the position of the head bracket 140 can be fixed in a position along a direction parallel to the third axis 'TA'. The position of the head bracket 140 is fixed in this manner because the flange 172 is welded to the head bracket 140 as best seen in FIGS. 7 and 8, and sandwiched between the arm 122 of the suspension mechanism 120 and the third fastener 168. The arm 122 of the suspension mechanism 120, the first fastener 162 extending through the arm and the third fastener 168 coupled to the first fastener 162 may remain stationary during the leveling operation. The head assembly 110 and the flange 172, on the other hand, may move in the downward direction during the leveling operation due to its weight. As the flange 172 moves relative to the third fastener 168 in the downward direction 'c', the third fastener 168 comes in from the first position 'e' to the second position 'f' (shown in FIGS. 12 and 13). Abutting the second fastener 166 against the third fastener 168 and engaging the third fastener 168 against the first fastener 162 (e.g., by tightening the head of the first fastener 162 using a wrench) locks the position of the third fastener 168, thereby fixing the position of the first portion 152 of the head assembly 110 with respect to the surface 200.

In some embodiments, the performance of the pad may be compromised by allowing the head assembly to be angled with respect to the surface. This provides pad assistance for moving the machine across the floors. Such embodiments generate a force due to the pad spinning in a plane angled with respect to the surface. The force can be useful for moving the machine across the surface. Such embodiments can be simpler and cost-efficient than providing a transmission system such as providing power to the wheels by an axle (not shown) coupled to the power source to assist the machine in moving across the floor (e.g., turning the machine). As shown in FIG. 5, the head adjustment mechanism 160 can adjust the angular orientation of the first portion 152 relative to the second portion 154 such that the pad 130 spins at a plane angled at an angle θ with respect to the surface. In the illustrated embodiment, θ is defined as the angle formed by a line connecting point 'Y' on the first portion 152 and point 'Z' on the second portion, and the reference axis 'RA'.

Figure 14:
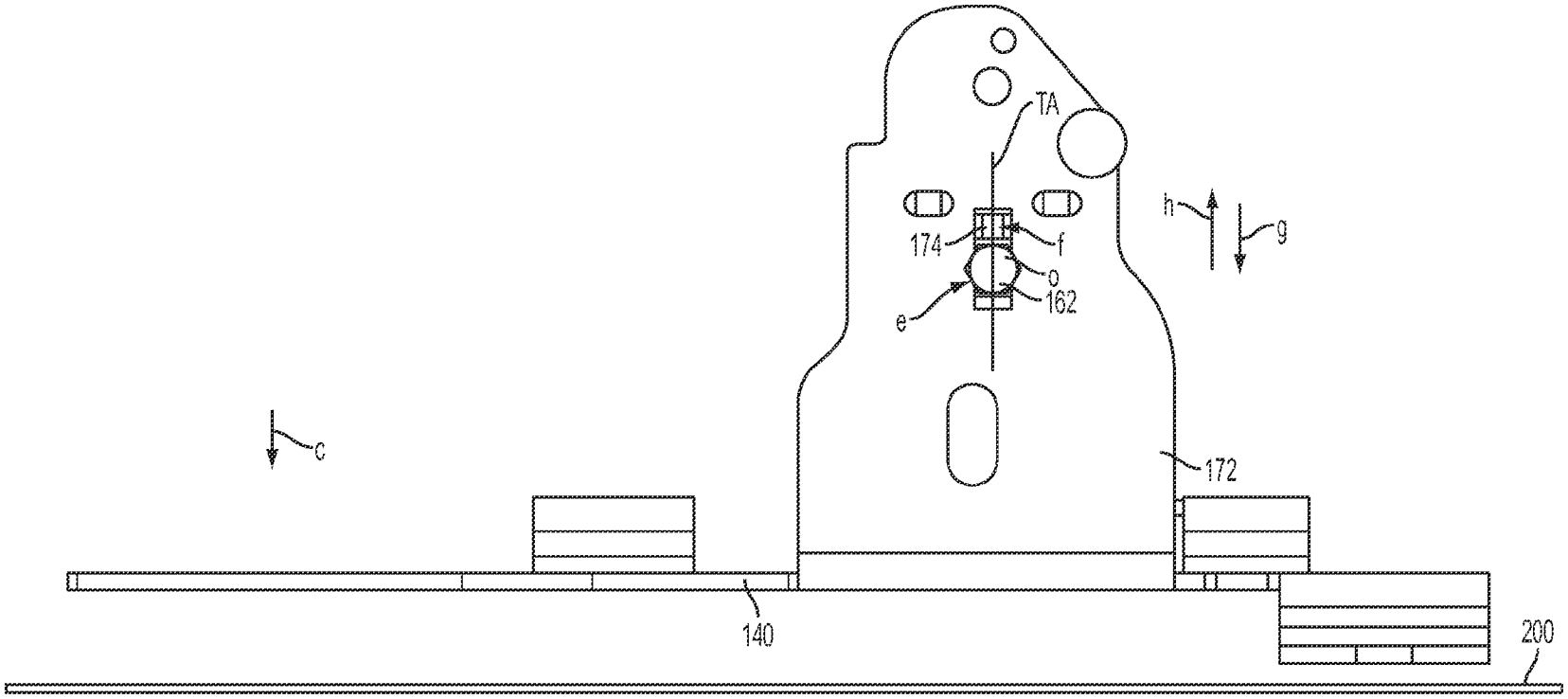
FIG. 14 is a side view of the head adjustment mechanism of FIG. 5.
Figure 15:
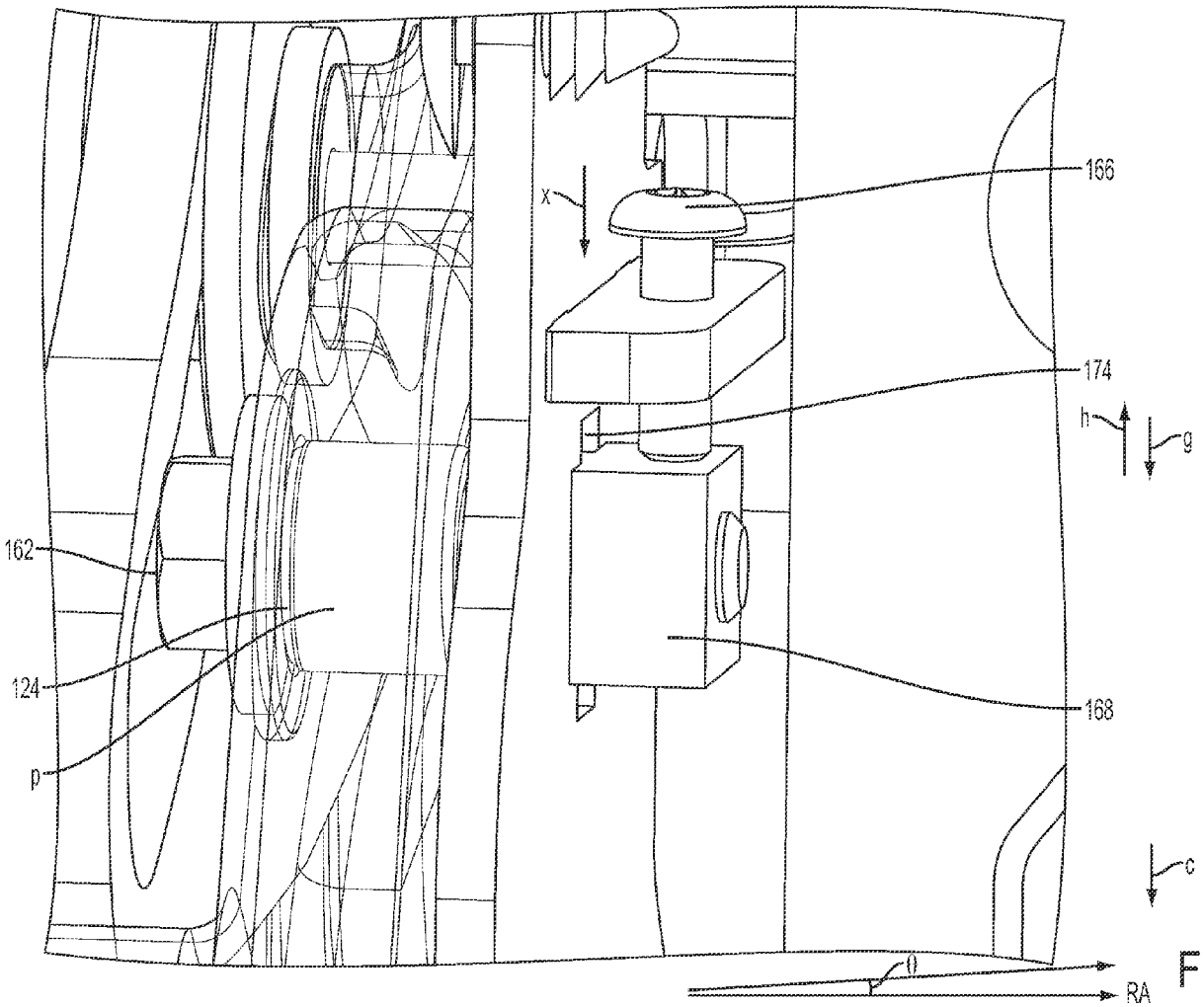
FIG. 15 is a side perspective view of the head adjustment mechanism of FIG. 5 with an arm of the suspension mechanism partially hidden.
Figure 16:
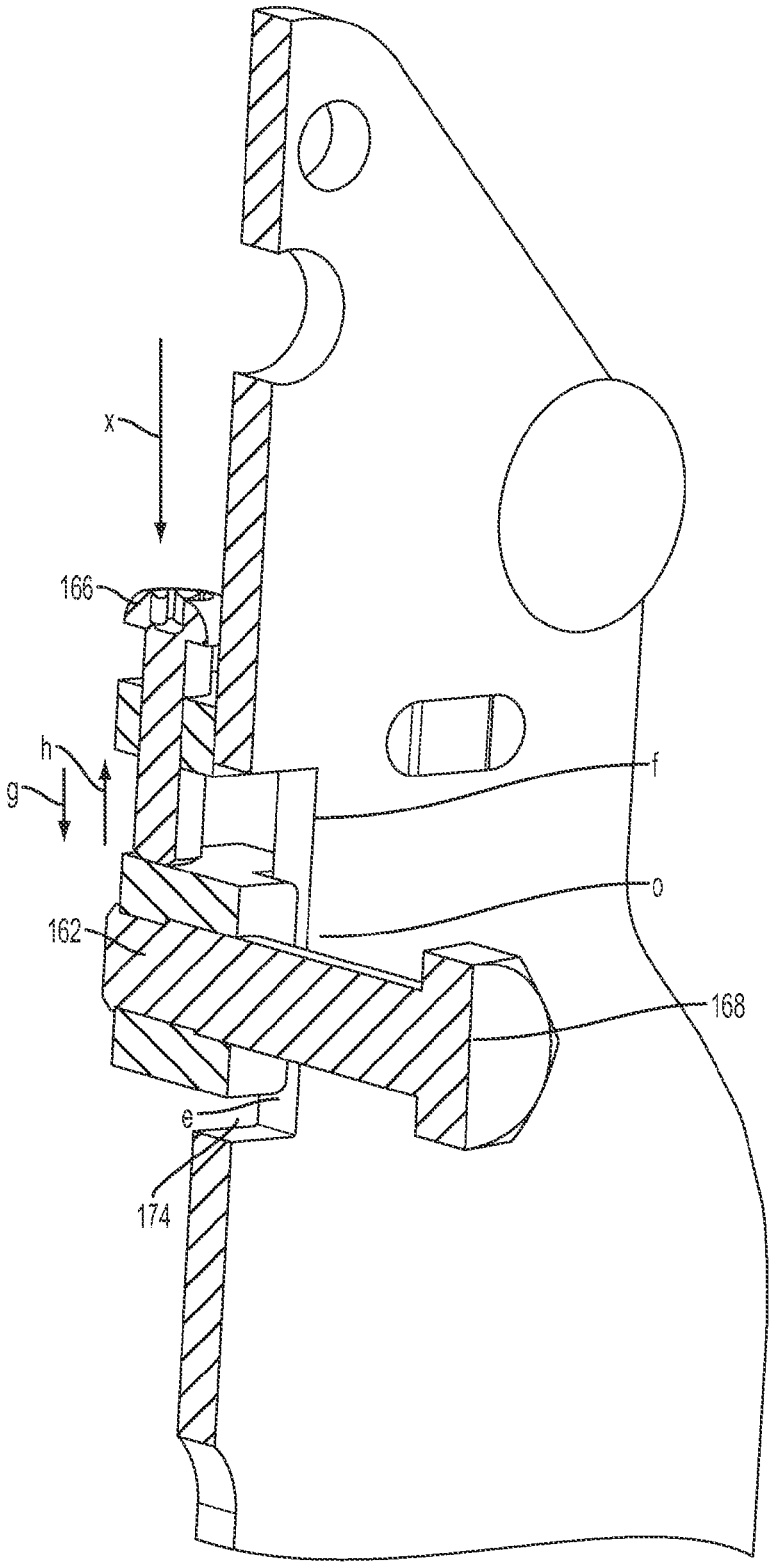
FIG. 16 is a sectional perspective view taken along the line 16-16 in FIG. 13.

As seen in FIGS. 14-16, the head adjustment mechanism 160 can be adjusted such that the third fastener 168 is positioned asymmetrically in the slot 174 (along the third axis 'TA') to allow more travel in the direction 'g' than in direction 'h'. This asymmetric travel can result in the first portion 152 being closer to the surface 200 than the second portion 154. In such embodiments best seen in FIGS. 14 and 16, the first position 'e' and second position 'f' of the third fastener 168 can be separated by a distance of 10 millimeters along the third axis 'TA'. In some embodiments, the first and second positions 'e' and 'f' are separated by a distance of 7 millimeters along the third axis 'TA'. In such embodiments, the head assembly 110 is angled with respect to the surface 200 because of the asymmetric positioning of the third fastener 168 in the slot 174. In some embodiments, the head assembly 110 may be angled in the range approximately 0.5 degrees to approximately 10 degrees with respect to surface 200. In some embodiments, the head assembly 110 may be angled approximately 2 degrees with respect to the surface.

When the head assembly 110 forms the angle θ with respect to the surface, the first portion 152 can remain closer to the surface 200 than the second portion 154, in a direction parallel to the third axis 'TA'. In a non-limiting exemplary embodiment, the side of the machine with the head adjustment mechanism 160 (e.g., referred to as "machine left side") can be closer to the surface 200 than the "machine right side" (the side of the machine without the head adjustment mechanism 160). In such embodiments, the pad 130 applies greater pressure on surface 200 at the machine left side than on the machine right side. For instance, if the pad 130 is a burnishing pad, the surface 200 may be polished to a greater extent on the machine left side than on the machine right side due to the angle 'θ' on the head assembly 110. Such embodiments, however, may generate a force that can be deployed for continuing propulsion to the machine 100.

In some embodiments, the surface maintenance machine 100 starts moving when a force of approximately 12 pounds is applied. In such embodiments, the surface maintenance machine 100 requires a force of approximately 8 pounds to remain moving. The head assembly 110 may be angled such that it provides the force of approximately 8 pounds required to keep the machine moving. In this embodiment, engaging the third fastener 168 locks the position of the third fastener 168, thereby fixing the position of a first portion 152 of the head assembly 110 with respect to a surface 200. The position of the third fastener 168 in the slot 174 can be varied until the desired angle is achieved. This typically involves the third fastener 168 to be positioned away from the center 'O' of the slot 174 as shown in FIGS. 12, 14 and 16.

In a non-limiting exemplary embodiment, not shown in the drawing figures, the head adjustment mechanism 160 can be coupled to a bracket 170 positioned on the frame 104 of the surface maintenance machine 100 and located distally to the head assembly 110. In a second exemplary embodiment, the head adjustment mechanism 160 can be coupled to an arm 122 of the suspension mechanism 120. As such the head adjustment mechanism 160 can be coupled to any location to perform head leveling or pad assistance. For example, the head adjustment mechanism 160 may be positioned between the suspension mechanism for lifting the head assembly 110 and the frame 104 of the surface maintenance machine 100. If the surface maintenance machine 100 includes sub-assemblies such as frame, wheels, etc., the head adjustment mechanism may be positioned at the intersection of any of the sub-assembly (frame, wheels, etc.) and the head assembly without loss of functionality. As such, the position of the head adjustment mechanism does not limit the scope and applicability of the head adjustment mechanism. In a second non-limiting exemplary embodiment, not shown in the drawing figures, the head adjustment mechanism 160 may include a first and second fastener to perform head adjustment. The number of fasteners of the head adjustment mechanism 160 does not limit the scope and applicability of the head adjustment mechanism.

In use, a technician may perform a leveling operation by lifting the head assembly 110 away from the surface 200. Reference is made to drawing FIGS. 12-16. For instance, the technician may engage the suspension mechanism 120 (e.g., by pressing a foot pedal, or switching an actuator on) to lift the head assembly 110. The technician may disengage the first fastener 162 to release the third fastener 168, and the flange 172 sandwiched between the arm 122 of the suspension mechanism 120 and the third fastener 168. The first fastener 162 extends through the suspension mechanism 120 and threadingly engages with the third fastener 168. Thus, when the suspension mechanism 120 remains stationary and away from the surface 200, the first and third fasteners 162, 168 remain stationary relative to the flange 172. The flange 172, on the other hand, tends to move downwardly due to the weight of the head assembly 110 to which the flange 172 is fixedly attached. Additionally, the flange 172 may pivotably rotate about the first fastener 162. As the flange 172 moves in a downward direction 'c', the third fastener 168 comes in contact with the slot 174 at the second position 'f'. The second position 'f' can be chosen such that when fixed, the head assembly 110 is leveled, and the pad 130 applies pressure evenly on surface 200 on the first and second portions 152, 154 of the machine axis 'MA'. The technician can advance the second fastener 166 in a first direction 'x' (shown in FIGS. 15 and 16) to fix the position of the third fastener 168 in the slot 174. The technician may use a gauge (e.g., a carpenter's level, not shown) positioned on the head assembly 110 to ensure that the head assembly 110 is leveled as the second fastener 166 is being advanced. The technician may then engage the first fastener 162 to lock the positions of all components of the head adjustment mechanism 160 and the head assembly 110. The head assembly 110 may be level with the surface 200. If the pad 130 is a burnishing pad 130, the surface 200 may be burnished or polished evenly on the first and second portions 152, 154 (e.g., machine left and right sides) of the machine axis 'MA'. The technician may use a gloss meter (not shown) to measure the reflectivity of the surface 200 on the first and second side of the machine axis 'MA', and ensure that the floor treatment is performed evenly.

In other embodiments, the flange 172 may not move in a downwardly direction when the first fastener 162 is released. This may be due to the position of the head adjustment mechanism with respect to the head assembly 110. For instance, if the head adjustment mechanism 160 is positioned away from the arm 122 of the suspension mechanism 120, then releasing (e.g., loosening) the first fastener 162 may not result in a downward motion of the head assembly 110. In such embodiments, releasing the first fastener 162 may result in releasing the third fastener 168 to slide in the slot 174. The technician may then continue performing the leveling operation as described previously to level the head assembly. Such embodiments are beneficial in allowing the technician to perform head adjustment as a "one-handed operation".

The technician may perform a pad assistance mechanism by following similar steps as those used in the leveling operation. For instance, the technician may release the first fastener 162 to release the flange 172 and the third fastener 168. Pad assistance is provided by introducing an angle on the head assembly 110 (e.g., by lowering the left side of the machine lower to the surface 200 than the right side). The technician may place a gauge on the head assembly 110 and advance the second fastener 166, until the indicator on the gauge is sufficiently offset from the 'zero' position, where the 'zero' position indicates a leveled head. The third fastener 168 may be fixed at a second position in the slot 174, and the second fastener 166 may abut the elongated portion of the third fastener 168 at this position. The technician may then engage the first fastener 162 to lock the position of various components of the head adjustment mechanism 160 and the head assembly 110. The angle of the head assembly 110 may result in the left side of the machine being lower than the right side, thereby generating a force to propel the machine across the surface 200. When locked, the angle of the head assembly 110 may provide pad assistance for propelling the machine across the surface 200.

Various surface maintenance machines have been described. The embodiment and elements herein described are exemplary and in no way limit the scope of the invention. Other embodiments may be apparent to those skilled in the art. Such embodiments, along with the ones described herein, are within the scope of the invention.

What is claimed is:

1. A surface maintenance machine, comprising:
a frame;
a plurality of wheels coupled to the frame;
a head assembly supported by the frame and coupled to a suspension system, the suspension system adapted to raise or lower the head assembly, the head assembly including:
a head bracket, and
a pad powered by a driver supported by the frame, the pad coupled to the head bracket, the pad adapted to treat a surface; and
a head adjustment mechanism coupled to the head assembly, the head adjustment mechanism adapted to adjust a position of the head assembly such that a first portion and a second portion of the head assembly disposed about a machine axis are equidistant from the surface, the head adjustment mechanism including:
a first fastener,
a second fastener having a longitudinal axis extending therethrough, and
a third fastener slidably coupled to at least a portion of the head bracket to permit movement of the first portion of the head assembly towards or away from the surface, the third fastener positioned against the head bracket at a first position,
the second fastener adapted to abut the third fastener at a second position separated from the first position along the longitudinal axis of the second fastener to prevent the third fastener from sliding further against the portion of the head bracket, and,
the first fastener adapted to lock the position of the third fastener to the head bracket.

2. The surface maintenance machine of claim 1, wherein the pad is a burnishing pad adapted to burnish a floor surface.

3. The surface maintenance machine of claim 1, wherein the pad is a scrubbing pad adapted to scrub a floor surface.

4. The surface maintenance machine of claim 1, wherein the third fastener is received by a slot in a flange.

5. The surface maintenance machine of claim 1, wherein the head adjustment mechanism is operatively coupled to the first portion of the head assembly, such that the first portion of the head assembly can be moved towards or away from the surface by adjusting the position of the third fastener in the slot.

6. The surface maintenance machine of claim 5, wherein the second fastener is a screw, the second fastener adapted to threadingly engage with a threaded opening defined in the flange.

7. The surface maintenance machine of claim 1, wherein the first fastener is a bolt.

8. The surface maintenance machine of claim 7, wherein the third fastener is a locking nut with a head portion, the third fastener threadingly engaging with the first fastener.

9. The surface maintenance machine of claim 1, wherein the head adjustment mechanism is coupled to an arm of a suspension mechanism adapted to raise or lower the head assembly.

10. The surface maintenance machine of claim 1, wherein the head adjustment mechanism is configured to raise or lower at least one of the first portion and the second portion with respect to the other of the first portion and the second portion such that when the pad applies pressure on the surface, the pressure is equal between the first portion and the second portion.

11. The surface maintenance machine of claim 1, wherein the head adjustment mechanism is coupled to a bracket positioned on the frame of the surface maintenance machine and located distally to the head assembly.

12. A surface maintenance machine, comprising:
a frame;
a plurality of wheels coupled to the frame;
a head assembly supported by the frame and coupled to a suspension system, the suspension system adapted to move a first portion of the head assembly towards or away from a surface, the head assembly including:
a head bracket, and
a pad powered by a driver supported by the frame, the pad coupled to the head bracket, the pad adapted to treat the surface; and
a head adjustment mechanism coupled to the head assembly, the head adjustment mechanism comprising:
a flange operatively coupled to the head bracket;
a first fastener extending through the flange, the first fastener having an elongated shank portion disposed about a first axis;
a second fastener having a second axis,
a third fastener received by the first fastener at a first position, the third fastener slidable with respect to the flange along a third axis perpendicular to the first axis and parallel to the second axis, the third fastener adapted to slide along the third axis between the first position and a second position, wherein,
disengaging the first fastener from the third fastener allows the third fastener to slide along the third axis, thereby permitting the first portion of the head assembly to move towards or away from the surface, the second fastener adapted to abut a head portion of the third fastener when the third fastener is at the second position, and, locking the third fastener with the first fastener adapted to fix a position of the third fastener, and thereby fix a position of the first portion of the head assembly with respect to the surface.

13. A surface maintenance machine comprising:

a frame;

a plurality of wheels coupled to the frame;

a head assembly supported by the frame and coupled to a suspension system, the suspension system adapted to move a first portion of the head assembly towards or away from a surface, the head assembly including:

a head bracket, and a pad powered by a driver supported by the frame, the pad coupled to the head bracket, the pad adapted to treat the surface; and a head adjustment mechanism coupled to the head assembly, the head adjustment mechanism comprising:

a flange operatively coupled to the head bracket;

a first fastener extending through the flange, the first fastener having an elongated shank portion disposed about a first axis;

a second fastener having a second axis, a third fastener received by the first fastener at a first position, the third fastener slidable with respect to the flange along a third axis perpendicular to the first axis and parallel to the second axis, the third fastener adapted to slide along the third axis between the first position and a second position, wherein, locking the third fastener with the first fastener adapted to fix a position third fastener, and thereby fix a position of the first portion of the head assembly with respect to the surface, such that a line connecting a first point on the pad at the first portion and a second point on the pad at a second portion of the head assembly forms an angle in a range approximately 0.5 degrees to approximately 10 degrees with respect to the surface.

14. The surface maintenance machine of claim 13, wherein the third fastener adapted to slide in a slot along the third axis between the first position and the second position, the first and second positions separated by a distance of 10 millimeters along the third axis.

15. The surface maintenance machine of claim 14, wherein the distance separating the first and second positions along the third axis is approximately 7 millimeters.

16. The surface maintenance machine of claim 13, wherein the pad is adapted to spin about a machine axis, the machine axis disposed symmetrically about the head assembly between the first portion and the second portion of the head assembly.

17. The surface maintenance machine of claim 16, wherein the surface maintenance machine requires a second force of approximately 8 pounds to remain moving, the second force generated due to the pad spinning about the machine axis, the pad being angled with respect to the surface.

18. The surface maintenance machine of claim 16, wherein the head adjustment mechanism is configured to raise or lower at least one of the first portion and the second portion with respect to the other of the first portion and the second portion such that when the pad applies pressure on the surface, the pressure is greater on the surface at the first portion than the second portion.

19. The surface maintenance machine of claim 13, wherein the line connecting the first point on the pad at the first portion and the second point on the pad at the second portion of the head assembly is angled approximately 2 degrees with respect to the surface.

20. The surface maintenance machine of claim 13, wherein the surface maintenance machine adapted to start moving from rest when a first force of approximately 12 pounds is applied, the first force supplied by a power source.

* * * * *